US005284304A

United States Patent [19]

Biagiotti

[11] Patent Number: 5,284,304

[45] Date of Patent: Feb. 8, 1994

[54] PERFORATING APPARATUS FOR PAPER WEBS AND THE LIKE, WITH RECIPROCATING MOTION OF TRANSLATION OF THE COUNTER-BLADE

[75] Inventor: Guglielmo Biagiotti, Capannori, Italy

[73] Assignee: Fabio Perini S.p.A., Lucca, Italy

[21] Appl. No.: 856,542

[22] Filed: Mar. 24, 1992

[30] Foreign Application Priority Data

Apr. 3, 1991 [IT] Italy ..... FI/91/A72

[51] Int. Cl.[5] ..... B65H 35/08

[52] U.S. Cl. ..... 242/56.8; 83/338; 83/678

[58] Field of Search ..... 242/56.8; 83/338, 660, 83/659, 678

[56] References Cited

U.S. PATENT DOCUMENTS

| | | | |
|---|---|---|---|
| 818,065 | 4/1906 | Ward | 83/338 |
| 3,086,416 | 4/1963 | Minarik | 83/678 |
| 3,595,117 | 7/1971 | Grettve et al. | 83/658 |
| 4,074,599 | 2/1978 | Allen | 83/678 |
| 4,240,312 | 12/1980 | Ward, Sr. | 83/338 |
| 4,295,843 | 10/1981 | Otomaru | 83/338 |

FOREIGN PATENT DOCUMENTS

| | | | |
|---|---|---|---|
| 2105687 | 3/1983 | United Kingdom | 242/56.8 |
| 2105688 | 3/1983 | United Kingdom | 242/56.8 |

*Primary Examiner*—Thomas B. Will
*Attorney, Agent, or Firm*—Francis J. Bouda

[57] ABSTRACT

A perforating apparatus is disclosed for rewinding machines and the like which includes a rotating roller (5), on which cutting blades (31) are disposed. A shaft (3) carries a perforating counter-blade (33) provided with indentations. An oscillating drive (57, 59, 61, 63, 65) is combined with the shaft (3) which causes the counter-blade 33 to move with reciprocating translation motion in a direction parallel to the axis of the rotating roller (5), so as to avoid a concentration of wear in the cutting blades (31).

7 Claims, 3 Drawing Sheets

PERFORATING APPARATUS FOR PAPER WEBS AND THE LIKE, WITH RECIPROCATING MOTION OF TRANSLATION OF THE COUNTER-BLADE

SUMMARY OF THE INVENTION

The invention refers to a perforating apparatus for rewinding machines and the like, of the type comprising a rotating roller on which cutting blades are disposed, and a shaft carrying a counter-blade.

Apparatus of this type are used in rewinders, for the paper converting industry, which transform a large roll of reeled paper material into a plurality of smaller rolls or logs of reduced diameter. The logs are subsequently cut along planes perpendicular to their longitudinal axis to obtain rolls of a desired length, for example, of toilet paper, kitchen towels, or all-purpose wipers for household use or the like. The perforating apparatus provides successive transversal and equidistant perforation lines along the web material. A rewinding machine of this type is described in U.S. Pat. No. 4,487,377. A similar rewinding machine, with a different winding system, is described in German Patent DE-A-32 25 518. The system for perforating the web material is similar in the two machines.

Each line of perforations is carried out by the contact of a cutting blade, having a continuous cutting edge, with an indented counter-blade. The counter-blade has a plurality of notches in the cutting edge; i.e., the edge is interrupted at intervals to provide a discontinuous cut of web material along ---------- the same perforation line. This contact between the two blades causes a wear of the cutting blade where it is struck by the segments of cutting edge of the indented counter-blade. In prior practices, in order to avoid a localized wear and a consequent indentation of the continuous cutting edge of the cutting blades, the rotating roller was provided with a plurality of indented counter-blades, which all cooperate with a single, non-rotatable fixed blade. The notches in the successive indented counter-blades were off-set so as not to correspond with each other. Thus the fixed blade became worn in a uniform manner without formation of indentations therein.

Such arrangement, however, had the drawback that, wishing to change the perforation pitch, i.e., the dimensions of the notches or indentations, it was necessary to replace and adjust all the indented counter-blades carried by the rotating roller, usually six or more. This required long shutdowns of the whole system with concurrent increases in production costs.

The object of the invention is a perforating apparatus for rewinders and the like, with such a provision of blades and counter-blades as to allow for an easy and fast replacement thereof when changing the perforations' pitch as desired, and moreover which avoids uneven wear of the smooth, continuous cutting blades.

These and other objects and advantages that will appear evident to those skilled in the art by a reading of the following description, are achieved by providing the non-rotating shaft with an indented counter-blade, and the rotating roller with blades having smooth cutting edges, and by combining means to said non-rotating shaft which cause a reciprocating motion of translation of said shaft, and the indented counter-blade, in a direction substantially parallel to the axis of the rotating roller.

A reciprocating motion of relative translation even of very small magnitude between the rotating cutting blades and the non-rotating counter-blade allows the contact between said cutting blades and the indented counter-blade to take place at different points along the cutting edge, so that the protrusions of the counter-blade will not always contact the same portions of the continuous cutting blades, thereby avoiding wearing indentations into the latter.

The invention will be better understood by the following description and the attached drawings which show a practical, not limiting exemplification of the invention.

With the above and other objects in view, more information and a better understanding of the present invention may be achieved by reference to the following detailed description.

DETAILED DESCRIPTION

For the purpose of illustrating the invention, there is shown in the accompanying drawings a form thereof which is at present preferred, although it is to be understood that the several instrumentalities of which the invention consists can be variously arranged and organized and that the invention is not limited to the precise arrangements and organizations of the instrumentalities as herein shown and described.

In the drawings, wherein like reference characters indicate like parts:

FIG. 1 shows schematically an example of a rewinder in which the perforating apparatus of the present invention may be used. However, it is evident that the structure of the rewinder and, in particular, the members for winding the web and those for cutting it upon completion of the winding may vary without implying a modification in the perforating apparatus.

Figure 1:
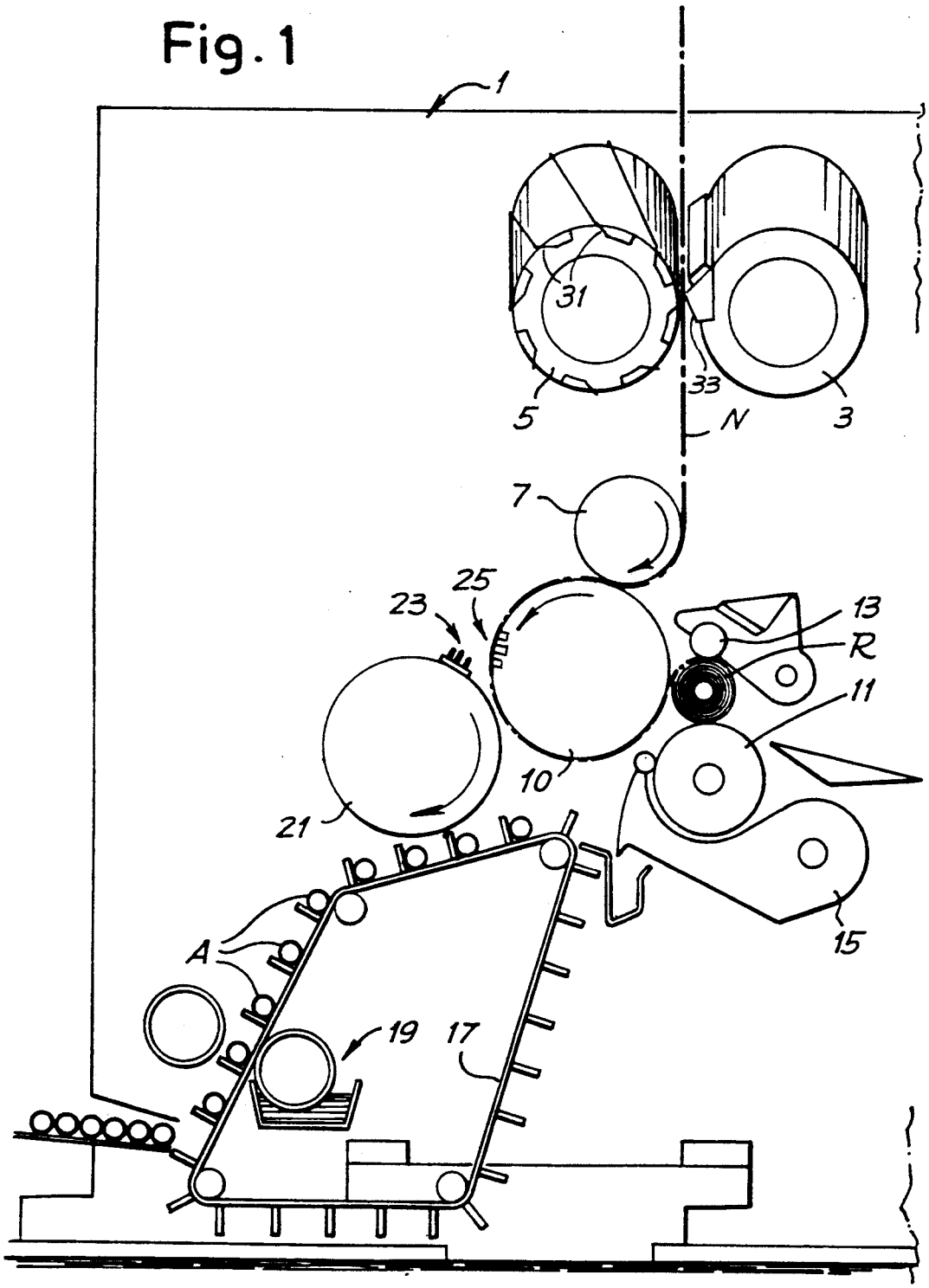
FIG. 1 shows a schematic view of a rewinder which embodies the perforating apparatus according to the invention.

In said FIG. 1, the rewinder, indicated by 1 as a whole, is provided with a perforating unit 3, 5 carrying a counter-blade 33, and one or more cutting blades 31, for creating a series of transversal perforations on the web N, which define the web tear lines. Disposed downstream of the perforating unit 3, 5 is a trailing cylinder 7 and a main winding roller 10 whose structure and operation are described in U.S. Pat. No. 4,487,377.

The web N is driven around the roller 10 and is wound on a core to form a roll or log R within a winding space defined by the roller 10, by a lower winding roller 11 and by a diameter-control roller 13. A core inserting means 15 picks up the cores from a continuous conveyor 17 to insert them into a nip defined by the main roller 10 and the lower winding roller 11. Associated to the conveyor 17 is a device generally indicated by 19 to apply glue onto the surface of the cores A.

Combined to the main roller 10 is a cutting cylinder 21 provided with a cutting means 23 described in U.S. Pat. No. 4,487,377. The cutting cylinder 21 is made to move periodically towards and against the main roller 10 to bring a cutting means 23 into cooperation with a counter-blade cutting means 25 disposed on the main roller 10, thereby causing the cutting of the web N in a manner to be described hereinafter. Said cut takes place after a roll R has been completed and prior to the insertion of the next core to start the winding of the subsequent roll. The rotary motion of the cutting cylinder 21 is timed to correspond with the rotation of the main roller 10 as described in U.S. Pat. No. 4,487,377, so as to maintain the two motions in phase and ensure that the cutting means 23 of the cutting cylinder 21 will properly cooperate all the time with the counter-blade means 25 located on the main roller 10.

According to the present invention, the cutting blades 31 carried by the roller 5 have a continuous smooth cutting edge and cooperate with an indented counter-blade 33 borne by the non-rotating shaft 3 which forms a substantially stationary support unit, except for a reciprocating motion of translation parallel to the axis of said roller 3.

Figures 2, 3:
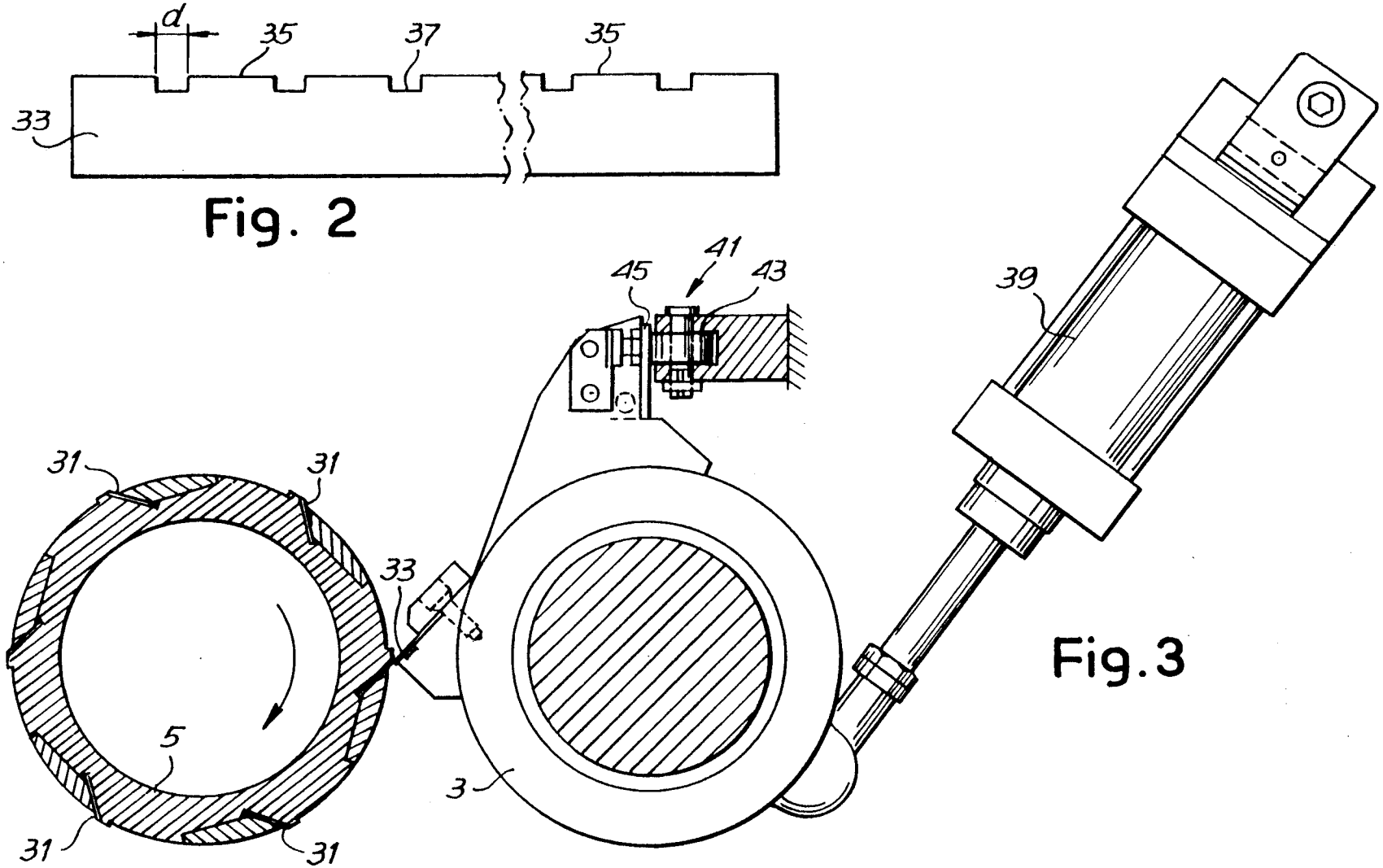
FIG. 2 shows an indented counter-blade.
FIG. 3 shows a cross-section of the perforating apparatus.
Figure 4:
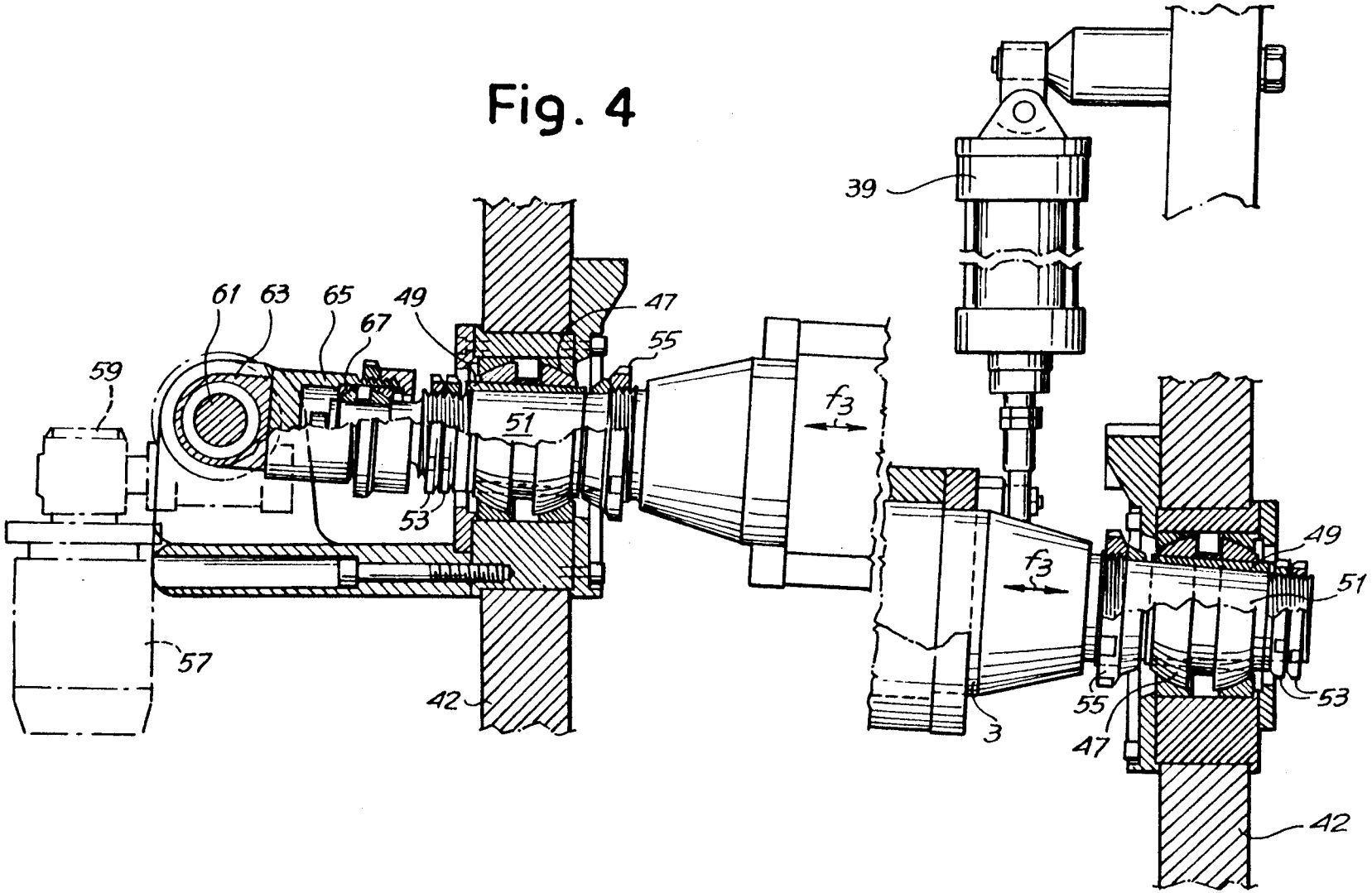
FIG. 4 shows a longitudinal section of the non-rotating shaft of the perforating apparatus.

The indented counter-blade 33 is shown in FIG. 2. As can be seen in this figure, the counter-blade 33 has a cutting edge 35 interrupted by notches or indentations 37 of length d. The protrusions between the notches 37 cooperate with the blades 31 to provide the desired perforations in web N.

The shaft 3 is pushed toward the rotating roller 5 by an actuator 39. Its location with respect to roller 5 is defined by an abutment, generally indicated by 41 formed by a small roller 43, which contacts the arm 45 of the shaft 3. The shaft 3 is supported in two frame members 42 through two end supports 47 with the interposition of conical bushes 49 fitted on conical terminal portions 51 of the same shaft 3 and locked thereon by locking ring nuts 53. The supports 47 are spherical which allow the shaft 3 to oscillate. Moreover, the bushes 49 inserted into the supports 47 allow for a limited motion of translation of shaft 3 in the direction of double arrow f3, i.e, parallel to its axis and to the axis of roller 5. Suitable ring nuts 55 are provided for disassemblying the conical bush 49.

The motion of translation of shaft 3 is obtained by means of a motor 57 which, via a reduction gear 59 having a high reduction ratio, drives into rotation a shaft having an eccentric 61 keyed thereon. Keyed on the eccentric 61, which has a very limited eccentricity, is the head 63 of a connecting rod 65. The connecting rod 65 is, in turn, connected to an end of shaft 3 through a spherical support 67 which allows relative oscillation movement between the connecting rod 65 and the shaft 3. The eccentricity of the eccentric 61 is of an order of magnitude similar to the length d of the notches or indentations 37 provided on the counter-blade 33.

When the rewinder is in operation, the roller 5 rotates at such a speed that the cutting blades 31 have peripheral speed proportional to the linear speed of the web N. The shaft 3 is urged by the actuator 39 against the abutment 41 and moves with reciprocating motion in the direction f3 controlled by motor 57. The abutment 41 provided by the small rollers 43 allows the motion of translation of shaft 3 with a minimum friction. In this way, the protrusions between the notches 37 of the counter-blade 33 are at a different position each time they come in contact with a cutting blade 31, thus avoiding a wear concentration on the cutting blades which would lead to the formation of indentations therein. The cutting blades 31 become uniformly worn and need to be replaced very rarely, while the single indented counter-blade 33 may be easily and rapidly replaced whenever it is desired to change the perforation pitch. The replacement operation, performed on the single counter-blade, require very short plant shutdowns and thus a reduction of the overall production costs.

It is to be understood that the present invention may be embodied in other specific forms without departing from the spirit or special attributes hereof, and it is therefore desired that the present embodiments be considered in all respects as illustrative, and therefore not restrictive, reference being made to the appended claims rather than to the foregoing description to indicate the scope of the invention.

Having thus described my invention, what is claimed as new and desired to protect by Letters Patent are the following:

1. A perforating apparatus for perforating a web material (N) in a rewinding machine comprising a rotating roller (5), on which cutting blades (31) are disposed, and a non-rotating shaft (3) carrying a perforating counterblade (33), characterized in that said counterblade (33) is indented and said blades have smooth cutting edges, that a drive means (57, 59, 61, 63, 65) combined to the shaft (3) provides a reciprocating translation motion of the shaft (3) in a direction (f3) parallel to the axis of said shaft (3), and that said shaft (3) is supported by end supports (47) which allow a variation of the inclination of the shaft (3) with respect to the web feeding direction as well as said reciprocating translation motion of the shaft in the direction (f3) parallel to the axis of said shaft (3).

2. An apparatus according to claim 1, characterized in that said shaft (3) is provided with a reciprocating motion parallel to the cutting edge of the counter-blade (33).

3. An apparatus according to claim 1 characterized in that said drive means (57, 59, 61, 63, 65) cause an oscillation of an extent equal to or slightly greater than a distance (d) between two adjacent lengths of cutting edge (35) of the counter-blade (33).

4. An apparatus according to claim 2, characterized in that said drive means (57, 59, 61, 63, 65) cause an oscillation of an extent equal to or slightly greater than a distance (d) between two adjacent lengths of cutting edge (35) of the counter-blade (33).

5. An apparatus according to claim 1 characterized in that said drive means comprises a linkage (61, 63, 65) operated by a motor-reducer (57, 59).

6. An apparatus according to claim 5, characterized in that said linkage comprises an eccentric (61) whose eccentricity is equal to or slightly greater than a distance (d) between, two adjacent lengths of cutting edge (35) of the counter-blade (33).

7. A rewinder for producing rolls of web material, including perforating means for transversely perforating said web material, characterized by a perforating apparatus according to any one of claims 1 to 6.

* * * * *